US006931987B2

(12) United States Patent
Pax et al.

(10) Patent No.: US 6,931,987 B2
(45) Date of Patent: Aug. 23, 2005

(54) VERTICALLY RETRACTABLE DOOR SYSTEM FOR A STAMPING PRESS

(75) Inventors: Steven J. Pax, Coldwater, OH (US); Allen P. Hartings, Coldwater, OH (US)

(73) Assignee: Fax Products, Inc., Celina, OH (US)

( * ) Notice: Subject to any disclaimer, the term of this patent is extended or adjusted under 35 U.S.C. 154(b) by 140 days.

(21) Appl. No.: 10/358,464

(22) Filed: Feb. 5, 2003

(65) Prior Publication Data

US 2004/0148864 A1 Aug. 5, 2004

(51) Int. Cl.[7] ..... B30B 15/00

(52) U.S. Cl. ..... 100/349; 100/345; 49/213

(58) Field of Search ..... 49/360, 445, 453, 49/463, 465, 213, 449; 100/345, 349; 192/134, 135

(56) References Cited

U.S. PATENT DOCUMENTS 3,531,895 A * 10/1970 Appell ..... 49/360
4,039,060 A * 8/1977 Williams et al. ..... 192/134
4,162,878 A * 7/1979 Puglisi et al. ..... 425/152
5,050,943 A * 9/1991 Barnett ..... 312/319.4
5,271,183 A * 12/1993 Hahn et al. ..... 49/360
6,244,412 B1 6/2001 Schmitz

FOREIGN PATENT DOCUMENTS

DE 3401332 A1 * 7/1985 ..... F24B/13/00

* cited by examiner

*Primary Examiner*—Jerry Redman
(74) *Attorney, Agent, or Firm*—Jacox, Meckstroth & Jenkins

(57) ABSTRACT

A vertically retractable door system for a stamping press includes a pair of vertical mounting plates having generally vertical opposing door guide channels with inwardly curved lower portions. A door with windows extends between the plates and includes support blocks enclosing bushings supporting rollers within the guide channels. Spring biased locking pins extend through a pair of the bushings into selectable vertically spaced holes within the mounting plates, and a rotatable latch handle is supported by the door and is connected to the locking pins by a drum and cable system for retracting the pins. The mounting plates have removable blocks within recesses extending from the channels to facilitate easy removal of the door, and enclosed counterweights are connected by cables and pulleys to the door to facilitate manual movement of the door between an upper retracted position and a lower closed position sloping downwardly and inwardly towards the press.

21 Claims, 2 Drawing Sheets

VERTICALLY RETRACTABLE DOOR SYSTEM FOR A STAMPING PRESS

BACKGROUND OF THE INVENTION

In the operation of a stamping press for sheet metal parts, for example, of the general type disclosed in U.S. Pat. No. 6,244,412, a lubricating fluid is commonly sprayed onto different areas of the stamping dies and/or of the sheet metal received within the press in order to obtain more accurately stamped parts and to extend the service life of the dies. It is also common to provide stamping presses with a vertically movable and counter balanced door which is pulled downwardly from an upper retracted position to a lower closed position before the stamping press is operated and to prevent the spray of excess lubricating fluid outside the boundaries of the lubricant collecting system for the press. With such a door, it is desirable to provide for quickly mounting the support for the door on the stamping press and to provide for easily removing the door when it is required to service the door or the press. It is also desirable for the door to be positioned close to the bolster or bed of the press when the door is in its lowered closed position so that excess lubricant which collects on the door will drain back into the lubricant collecting and recirculating system. It is further desirable for the door to be light weight and durable in construction, simple to operate manually and counter balanced for easy opening and closing with one hand as well as provide for a positive locking system which is easy to actuate and prevents operation of the press until the door is in its lower closed and locked position.

SUMMARY OF THE INVENTION

The present invention is directed to an improved vertically retractable door system for a metal stamping press and which provides all of the desirable advantages mentioned above. In accordance with a preferred embodiment of the invention, the door glides smoothly from an upper vertical retracted position to a lower closed position where the door is inclined inwardly and downwardly with the lower edge portion adjacent the press bolster. The door system includes a pair of vertical side mounting plates which may be quickly mounted on the side walls of the press and in which are formed guide channels for receiving a set of rollers mounted on opposite side edge portions of the door.

The lower portions of the channels curve inwardly to guide the door smoothly to its inclined lower closed position, and the side mounting plates have a series of vertically spaced holes within the guide channels for receiving retractable locking pins simultaneously actuated by a rotary handle mounted on the center portion of the door. The door guide channels have laterally extending cavities which are normally filled by corresponding blocks that are removed to provide for convenient removal of the door from the side guide plates. The guide plates are also provided with bottom inclined troughs which receive excess lubricant from a bottom channel on the door and return the lubricant to the press lubrication system. The door is further provided with a safety interlock switch which is connected into the press control circuit for stopping the press in the event the door is released and moved from its lower closed position.

Other features and advantages of the invention will be apparent from the following description, the accompanying drawings and the appended claims.

DESCRIPTION OF THE PREFERRED EMBODIMENT

Figure 1:
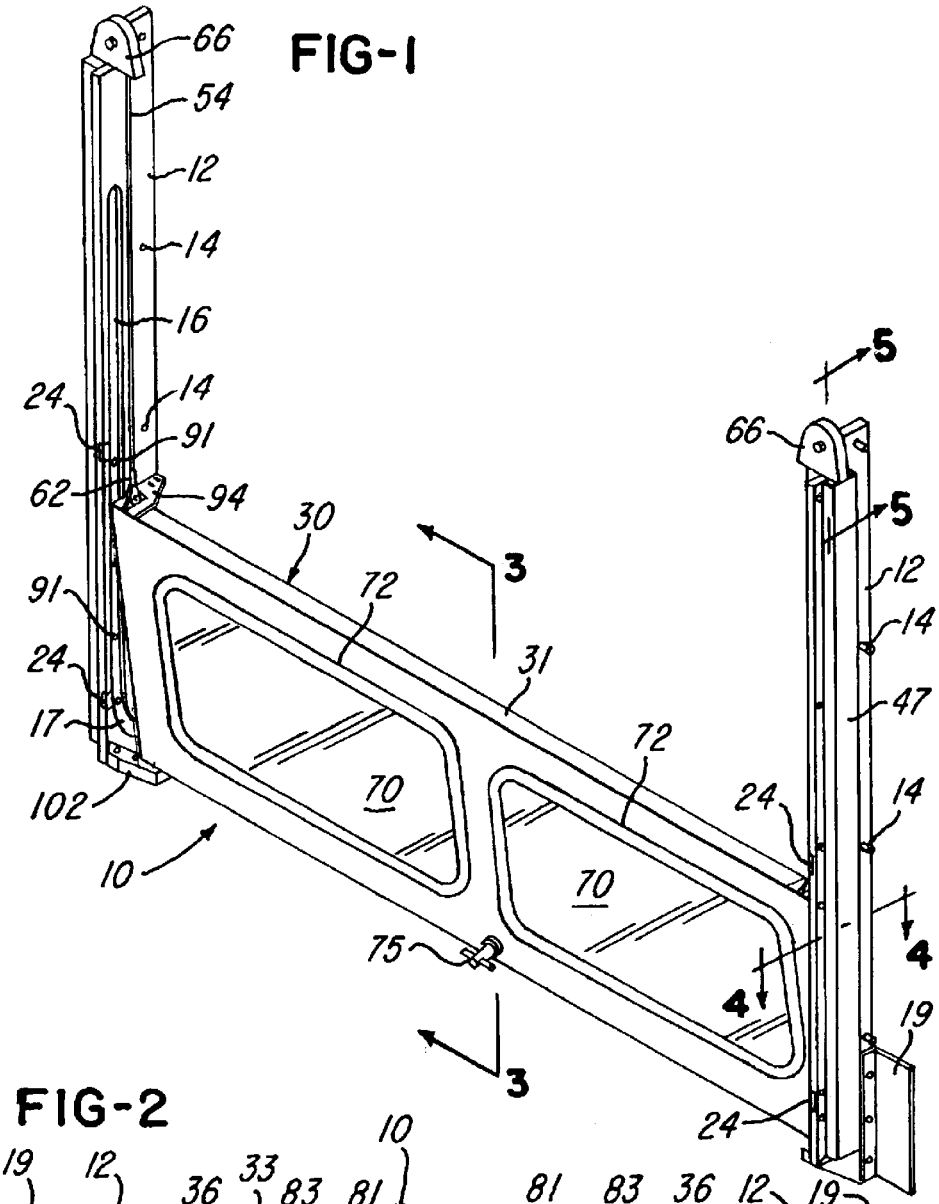
FIG. 1 is a perspective view of a retractable door system constructed in accordance with the invention and adapted to be mounted on a conventional stamping press for sheet metal parts.
Figure 3:
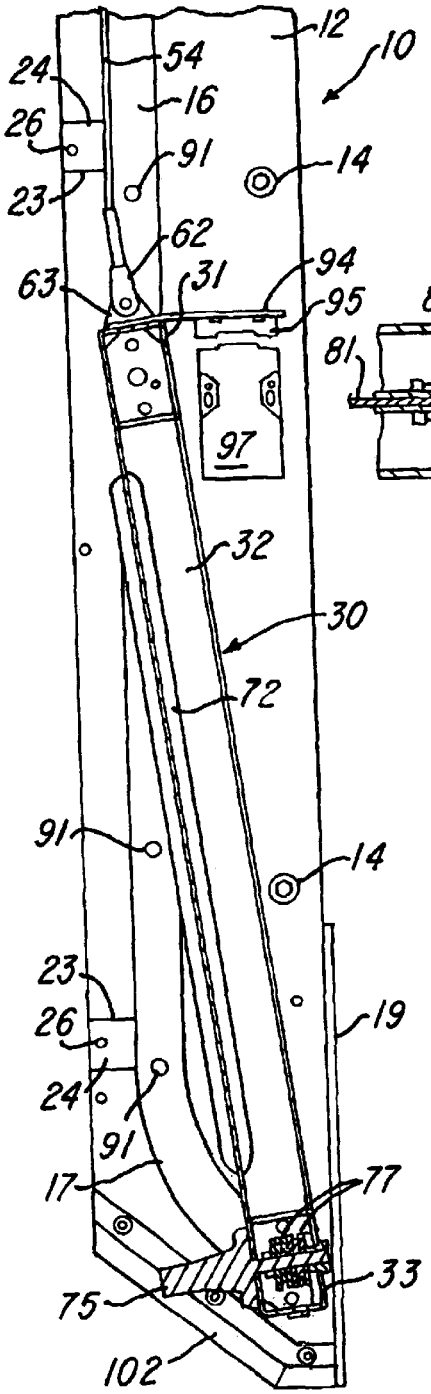
FIG. 3 is a fragmentary section of the door system, taken generally on the line 3—3 of FIG. 1.

FIG. 1 illustrates a vertically retractable door system 10 for a mechanical sheet metal stamping press and which includes a pair of vertical side track members or mounting plates 12 each having a series of vertically spaced holes for receiving bolts or machine screws 14 for securing the plates 12 to the side walls 15 (FIG. 4) or columns of the stamping press. Each of the mounting plates 12 is machined with a generally vertically extending and laterally inwardly facing channel 16 (FIGS. 1 & 3) having a lower portion 17 which curves inwardly towards the stamping press. A pair of L-shaped brackets 19 are secured to the lower end portions of the mounting plates 12. As shown in FIG. 3, each of the plates 12 is also formed with a pair of vertically spaced recesses or cavities 23 which extend from the channel 16 to the outer edge of the mounting plate and have the same depth as the channel 16. The cavities 23 are normally filled by pads or block members 24 which are retained by corresponding removable screws 26.

Figure 2:
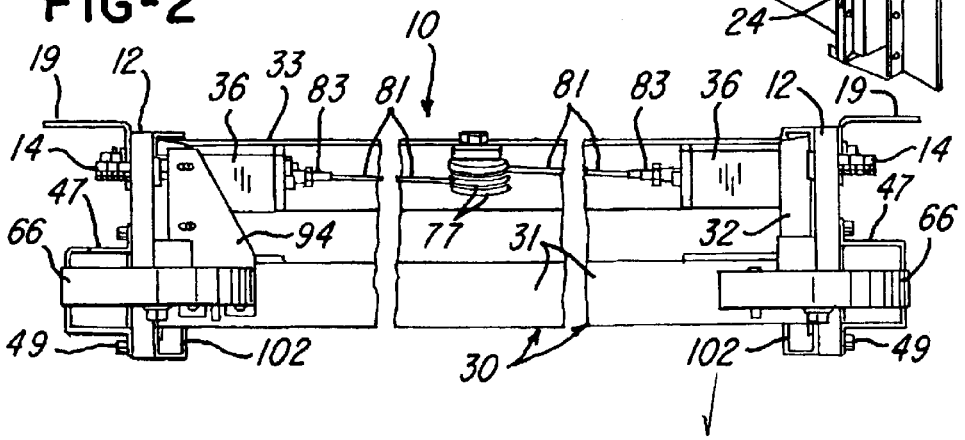
FIG. 2 is a top view of the door system shown in FIG. 1.

A formed sheet metal door 30 extends between the mounting plates 12 and has a top channel portion 31, opposite side channel portions 32, and a bottom channel portion 33 which are formed by bending the sheet metal panel forming the door 30. Each side portion of the door 30 includes upper and lower support blocks 36 which are mounted within the channel portions 31, 32 and 33. Each support block supports a tubular bushing 38 having an outer end portion 41 projecting from the side edge of the door for supporting a plastic wheel or roller 42 within the guide channel 16 of the corresponding mounting plate 12. The rollers 42 and the guide channels 16 with their lower curved portions 17, provide for moving the door 30 between and upper retracted position (not shown) and a lower closed position (FIGS. 1–3) where the door 30 is inclined and projects inwardly and downwardly to the inner edges of the mounting plates 12 which are usually adjacent the press bolster.

Figure 5:
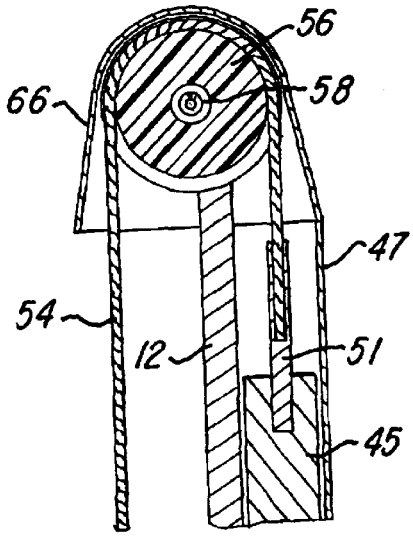
FIG. 5 is a fragmentary section taken generally on the line 5—5 of FIG. 1.

The door 30 is counterbalanced by a pair of counterweights 45 (FIG. 5) each of which is enclosed for vertical movement within a vertically extending enclosure or housing 47 having side flanges secured to the corresponding mounting plate 12 by a series of vertically spaced screws 49. Each of the counterweights 45 is connected by a fitting 51 (FIG. 5) to one end portion of a flexible tension member or cable 54 which extends over a plastic pulley 56 supported for rotation by a roller bearing 58 and axle secured to the upper end portion of the corresponding mounting plate 12. Each of the cables 54 has an opposite end portion which is secured to a fitting 62 (FIG. 3) pivotally connected to a bracket 63 secured to the upper edge portion of the door 30. An open bottom cover 66 extends over each of the pulleys 56 and the portion of the cable 54 extending over the pulley. The counterweights 45 have substantially the same weight as the door 30 so that the door may be easily moved manually by one hand of the operator between its upper retracted and open position and its lower inclined closed position. As shown in FIG. 1, the sheet metal door 30 includes a pair of plastic or polycarbonate windows 70 each of which is retained by a surrounding resilient or rubber window gasket 72 which receives the window and the sheet metal.

The lower channel portion 33 of the door 30 carries a lock system including a rotatable T-shaped handle 75 which supports a set of adjacent cable drums 77 for rotation in opposite directions within the bottom channel portion 33 of the door. A pair of cables 81 have inner end portions wrapped partially around the corresponding drums 77 and are anchored to the drums. The opposite end portion of each cable 81 is connected by a fitting 83 (FIG. 4) to the inner end portion of a lock pin 85 supported for axial movement within the corresponding tubular bushing 38 supporting the bottom roller 42. A compression spring 87 biases the lock pin 85 laterally outwardly so that the outer end portion 88 of the lock pin 85 will project into one of a series of vertically spaced holes 91 (FIG. 3) formed within the mounting plate 12 at the bottom of the channel 16. When it is desired to release the door 30 for vertical movement along the guide tracks or channels 16, the handle 75 is rotated to retract the pair of lock pins 85 from the corresponding holes 91 and to compress the springs 87, thereby releasing the door for movement.

Figure 4:
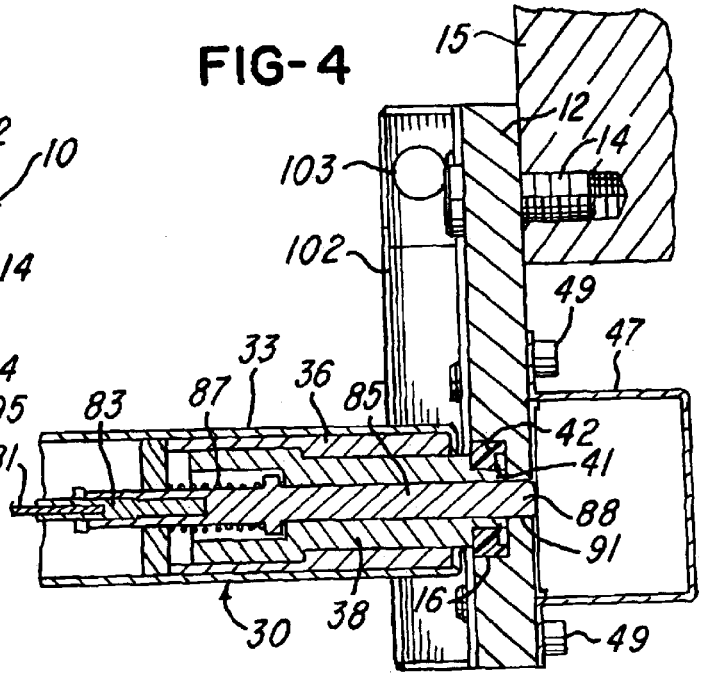
FIG. 4 is a fragmentary section of the right mounting plate, taken generally on the line 4—4 of FIG. 1 and with the door in a partially opened and locked position.

A bracket 94 is mounted on the top edge of the door 30 adjacent the left mounting plate 12 (FIG. 1) and projects inwardly towards the press to support an actuator or key 95 which actuates a safety interlock switch 97 connected in the control circuit for the stamping press. Thus as soon as the door 30 is elevated or raised from its lower closed position (FIG. 3), the safety switch 97 is actuated or opened to assure that the press is stopped. As also shown in FIGS. 1, 3 and 4, a formed sheet metal lubricant trough 102 is secured to the lower end portion of each mounting plate 12 and has a bottom drain outlet 103 (FIG. 4). Any excess lubricant which is sprayed onto the inner surface of the door 30 is collected within the bottom channel portion 33 of the door and drains from opposite ends of the channel portion 33 into the troughs 102. The excess lubricant then flows downwardly and through the outlet 103 of each trough 102 and into a lubricant collecting system for the press so that the lubricant may be filtered and recirculated.

From the drawings and the above description, it is apparent that a retractable door system constructed in accordance with the invention, provides desirable features and advantages. For example, the curved lower portion 17 of each guide track or channel 16 provides for smoothly moving the lower edge portion of the door to a position adjacent the press bolster when the door is in its lower inclined closed position, as shown in FIG. 3. This provides for greater freedom of design for the door system and for avoiding obstructions on the press. Prior door designs require mounting the door farther away from the bolster in order to avoid obstructions. The door system of the invention also provides for improved containment and control of the lubricant around the stamping press. The door support rollers 42 and the guide channels 16 also cooperate with the door counterbalancing system 45 to provide for smooth and easy movement of the door between its upper retracted position and its lower closed position.

The latch system, including the rotatable handle 75 and the spring-biased retractable lock pins 85 connected by the cables 81, also provides for positively locking the door 30 in its closed position as well as a selected elevated position as defined by the location of the holes 91 within the plates 12 at the bottom of the guide channels 16. The plastic door support rollers 42 and the plastic pulleys 56 further eliminate any requirement for lubricating the door guiding and elevating mechanism, and the troughs 102 cooperate with the bottom door channel 33 to return for recirculation any excess lubricant sprayed onto the door 30. In addition, the parallel side mounting plates 12 provide for easy attachment of the door system 10 to the side walls or uprights of the stamping press. When it is desired to remove the door 30 from the side guide plates 12, the two block members 24 on each plate 12 are simply removed from the corresponding cavities 23, and the door 30 is moved to a position where all of the rollers 42 will simultaneously pass through the cavities 23 to remove the door from the channels 16 and the mounting plates 12 without removing the rollers.

While the form of door system herein described constitutes a preferred embodiment of the invention, it is to be understood that the invention is not limited to this precise form of door system, and that changes may be made therein without departing from the scope and spirit of the invention as defined in the appended claims.

What is claimed is:

1. A vertically retractable door system in combination with a stamping press having horizontally spaced opposite vertical side walls, comprising a pair of generally vertical track members mounted on said side walls of said press, a generally vertical door extending horizontally between said track members and supported by said track members for generally vertical movement, a counterbalancing system connected to said door and counterbalancing the weight of said door, and said track members include guides directing said door from a generally vertical upper retracted position and an inclined lower closed position sloping downwardly and inwardly towards said press to position a bottom edge portion of said door closer to said press.

2. A door system as defined in claim 1 wherein said track members comprise parallel spaced and vertical mounting plates forming generally vertical guide channels having inwardly curved lower portions, and a set of rollers mounted on opposite edge portions of said door and projecting into corresponding said channels.

3. A door system as defined in claim 2 wherein at least one of said plates has upper and lower cavities extending laterally to said channel, and a removable block member within each said cavity to facilitate easy removal of said door from said plates without removing said rollers from said door.

4. A door system as defined in claim 1 wherein said track members have vertically spaced holes, a latch handle supported for rotation by said door, a set of spring biased retractable locking pins mounted on opposite edge portions of said door for selectively engaging said holes, and a cable and drum system connecting said latch handle to said locking pins to effect retraction of said locking pins against said springs in response to rotation of said handle.

5. A door system as defined in claim 4 wherein said locking pins are supported for axial movement within corresponding support members including tubular portions projecting into said guide tracks, and a set of rollers mounted on said tubular portions of said support members and confined by said guide tracks.

6. A door system as defined in claim 1 wherein said track members comprise parallel spaced vertical mounting plates, said counter-balancing system comprising a pulley supported for rotation by an upper end portion of each said plate, a flexible member extending over each said pulley and having a portion connected to said door, a counterweight connected to each said flexible member, and a housing removably mounted on each said mounting plate by a plurality of screws and enclosing the corresponding said counterweight.

7. A door system as defined in claim 1 wherein said door has a lower generally horizontal channel portion adapted to collect excess lubricant sprayed onto an inner surface of said door, and an open top elongated trough member on a lower portion of at least one of said track members for receiving excess lubricant from said channel portion of said door and adapted to direct the excess lubricant to a press lubricant collecting system.

8. A door system as defined in claim 1 wherein said track members comprise parallel spaced vertical solid metal mounting plates defining generally vertical guide channels having inwardly projecting lower portions forming said guide tracks, a set of rollers mounted on opposite edge portions of said door and projecting into corresponding said channels, a plurality of vertically spaced holes within each of said mounting plates, and a set of retractable locking pins mounted on opposite edge portions of said door for selectively engaging said holes.

9. A vertically retractable door system in combination with a stamping press having horizontally spaced opposite vertical side walls, comprising a pair of parallel spaced vertical solid metal plate members mounted on said side walls of said press, a generally vertical door extending horizontally between said plate members, a counterbalancing system connected to said door and counterbalancing the weight of said door, said solid metal plate members defining generally vertical guide channels recessed within said plate members, and said door having side portions supporting rollers projecting into said channels and directing said door generally vertically between an upper retracted position and a lower closed position sloping downwardly and inwardly towards said press to position a bottom edge portion of said door closer to said press.

10. A door system as defined in claim 9 wherein said guide channels have inwardly curved lower portions for moving said door to a downwardly and inwardly sloping said lower closed position.

11. A door system as defined in claim 9 wherein at least one of said plates has upper and lower cavities extending laterally to said channel, and a removable block member within each said cavity to facilitate easy removal of said door from said plates without removing said rollers from said door.

12. A door system as defined in claim 9 wherein said guide channels have vertically spaced holes, a latch handle supported for rotation by said door, a set of spring biased retractable locking pins mounted on opposite edge portions of said door for selectively engaging said holes, and a cable system connecting said latch handle to said locking pins to effect retraction of said locking pins against said springs in response to rotation of said handle.

13. A door system as defined in claim 12 wherein said locking pins are supported for axial movement within corresponding support members including tubular portions projecting into said channels, and said rollers are mounted on said tubular portions of said support members within said guide channels.

14. A door system as defined in claim 9 wherein said counterbalancing system comprises a pulley supported for rotation by an upper end portion of each said plate member, a flexible member extending over each said pulley and having a portion connected to said door, a counterweight connected to each said flexible member, and a housing removably mounted on each said plate member by a plurality of screws and enclosing the corresponding said counterweight.

15. A door system as defined in claim 9 wherein said door has a lower generally horizontal U-shaped channel portion adapted to collect excess lubricant sprayed onto and flowing down an inner surface of said door, and an open top elongated trough member on a lower portion of at least one of said plate members for receiving excess lubricant from said channel portion of said door and adapted to direct the excess lubricant to a press lubricant collecting system.

16. A door system as defined in claim 9 and including a plurality of vertically spaced holes within each of said mounting plates and extending from said guide channels, and a set of spring biased retractable locking pins mounted on opposite edge portions of said door for selectively engaging said holes.

17. A vertically retractable door system in combination with a stamping press having horizontally spaced opposite vertical side walls, comprising a pair of parallel spaced vertical side plate members mounted on said side walls of said press, a generally vertical door extending horizontally between said plate members, a counterbalancing system connected to said door for counterbalancing the weight of said door, said plate members defining generally vertical guide channels recessed within said plate members and having inwardly extending lower portions, said door having side portions supporting rollers projecting into said channels for moving said door generally vertically between an upper retracted position and a downwardly and inwardly sloping lower closed position, a plurality of vertically spaced holes within each of said mounting plates, and a set of retractable locking pins mounted on opposite edge portions of said door for selectively engaging said holes.

18. A door system as defined in claim 17 wherein at least one of said plates has upper and lower cavities extending laterally to said channel, and a removable block member within each said cavity to facilitate easy removal of said door from said plates without removing said rollers from said door.

19. A door system as defined in claim 17 wherein said locking pins are supported for axial movement within corresponding support members including tubular portions projecting into said channels, and said rollers are mounted on said tubular portions of said support members within said guide channels.

20. A door system as defined in claim 17 wherein said counterbalancing system comprises a pulley supported for rotation by an upper end portion of each said plate, a flexible member extending over each said pulley and having a portion connected to said door, a counterweight connected to each said flexible member, and a housing removably mounted on each said mounting plate and enclosing the corresponding said counterweight.

21. A door system as defined in claim 17 wherein said door has a lower generally horizontal channel portion adapted to collect excess lubricant sprayed onto an inner surface of said door, and a trough member on a lower portion of at least one of said plate members for receiving excess lubricant from said channel portion of said door and adapted to direct the excess lubricant to a press lubricant collecting system.

* * * * *

UNITED STATES PATENT AND TRADEMARK OFFICE

CERTIFICATE OF CORRECTION

PATENT NO. : 6,931,987 B2 
DATED : August 23, 2005
INVENTOR(S) : Steven J. Pax and Allen P. Hartings It is certified that error appears in the above-identified patent and that said Letters Patent is hereby corrected as shown below:

Title page,
Item [73], Assignee, delete "Fax" and insert -- Pax --.

Signed and Sealed this

Fourth Day of October, 2005

JON W. DUDAS
*Director of the United States Patent and Trademark Office*